US006988505B2

(12) United States Patent
Powell et al.

(10) Patent No.: US 6,988,505 B2
(45) Date of Patent: Jan. 24, 2006

(54) EXPANDABLE CANOPY

(75) Inventors: Billy R. Powell, Holly Springs, NC (US); Toney A. Powell, Raleigh, NC (US); David R. Powell, Holly Srings, NC (US)

(73) Assignee: Powell & Powell Supply Co., Inc., Lillington, NC (US)

( * ) Notice: Subject to any disclaimer, the term of this patent is extended or adjusted under 35 U.S.C. 154(b) by 111 days.

(21) Appl. No.: 10/232,005

(22) Filed: Aug. 30, 2002

(65) Prior Publication Data

US 2004/0040590 A1 Mar. 4, 2004

(51) Int. Cl.
*E04H 15/36* (2006.01)

(52) U.S. Cl. ..... 135/128; 135/124

(58) Field of Classification Search ..... 135/97, 135/115, 121, 124, 128, 900, 908
See application file for complete search history.

(56) References Cited

U.S. PATENT DOCUMENTS 2,714,386 A * 8/1955 Worsham ..... 135/115
5,117,853 A * 6/1992 Pruesner ..... 135/121
5,335,684 A * 8/1994 Hanninen ..... 135/124
6,155,280 A * 12/2000 Powell et al. ..... 135/124

FOREIGN PATENT DOCUMENTS

FR 2640669 * 6/1990

* cited by examiner

*Primary Examiner*—James O. Hansen
(74) *Attorney, Agent, or Firm*—Coats & Bennett, P.L.L.C.

(57) ABSTRACT

Canopies traditionally come in the form of canopy kits, and once erected, provide portable shelter for property, outdoor parties, etc. However, while canopies are useful in a wide variety of applications, the erected canopy structure is often restricted to a fixed size. The present invention discloses a canopy structure kit for a canopy that is transversely expandable from a first width, typically wide enough for an automobile, to a second width, typically wide enough for two automobiles. The expandable canopy structure kit includes extension members to expand the frame structure, and at least one cover adapted to fit the erected frame structure, whether the frame structure assumes an expanded or unexpanded configuration.

17 Claims, 5 Drawing Sheets

EXPANDABLE CANOPY

FIELD OF THE INVENTION

The present invention relates to portable shelters, and more particularly to expandable canopy structure kits.

BACKGROUND OF THE INVENTION

Portable shelters, in the form of canopy structures, have a wide variety of consumer applications. For example, these structures provide the consumer with affordable shelter for valuable equipment, such as automobiles, boats, recreational vehicles, etc. However, traditional canopy structures come in fixed sizes, forcing the consumer to purchase an assortment of canopy structures suitable for a variety of applications. As such, there is a need for a more flexible canopy structure, in terms of size, that can be assembled from a canopy kit.

SUMMARY

The present invention provides a method and apparatus for an expandable canopy structure. The expandable canopy structure kit includes a frame structure and at least one cover adapted to fit the frame structure. The frame structure includes at least two side frames, a ridge member, and a plurality of transversely expandable roof members disposed on opposing sides of the ridge member, between the ridge member and the side frames.

The plurality of transversely expandable roof members includes a plurality of first sections and a plurality of second sections. A canopy of a first width, erected with roof members comprising only the first sections, expands to a canopy of a second width by joining at least one second section end-to-end with each of the plurality of first sections.

In one embodiment of the present invention, the canopy kit provides at least two covers of different sizes to fit at least two possible frame structure widths. Therefore, each erected frame structure has a separate cover adapted to that frame structure.

A second embodiment of the canopy kit provides a transversely expandable or convertible cover comprising a first cover of a first width with an expandable center piece. The expandable center piece comprises at least one expansion panel that converts a cover having a first width to a cover having a second width.

DESCRIPTION OF EXEMPLARY EMBODIMENTS

Figure 2:
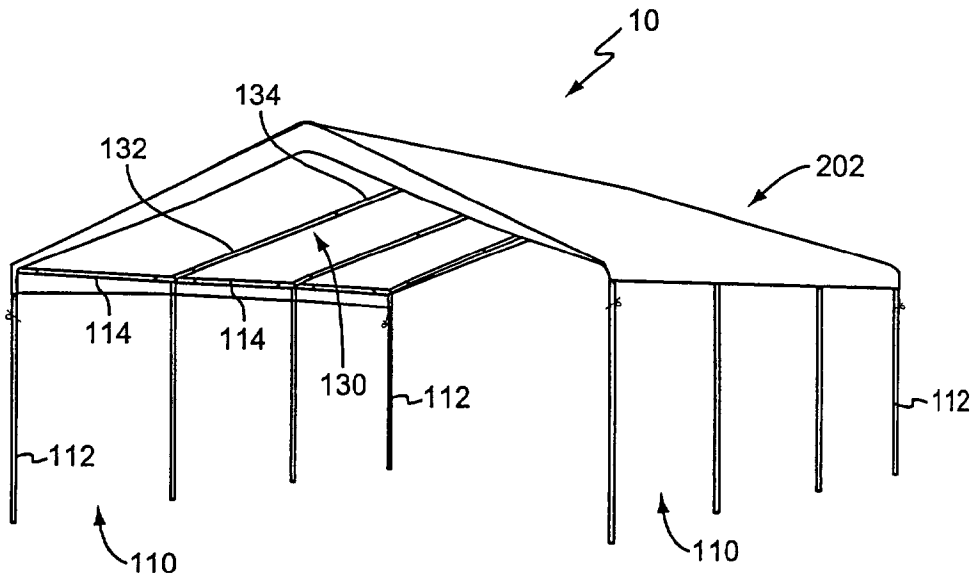
FIG. 2 illustrates an expanded canopy structure.
Figure 1:
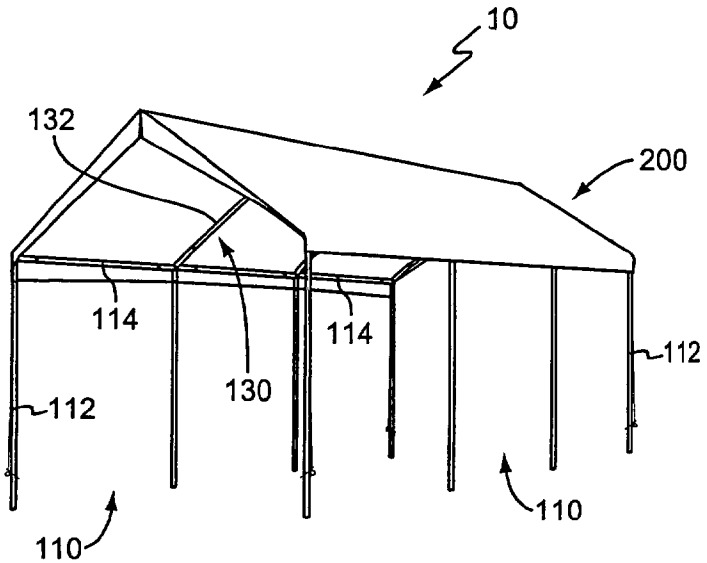
FIG. 1 illustrates a canopy structure.

The present invention comprises a canopy kit that includes an array of components that can be assembled to form a canopy structure 10 such as shown in FIGS. 1 and 2.

More particularly, the canopy kit of the present invention is designed to enable one to erect a canopy structure of one size or a canopy structure of a second size. In the embodiment illustrated herein, the canopy kit is designed such that a canopy of a first width such as shown in FIG. 1 can be assembled and erected, or a canopy of a second width, shown in FIG. 2, can be assembled and erected.

Figure 3:
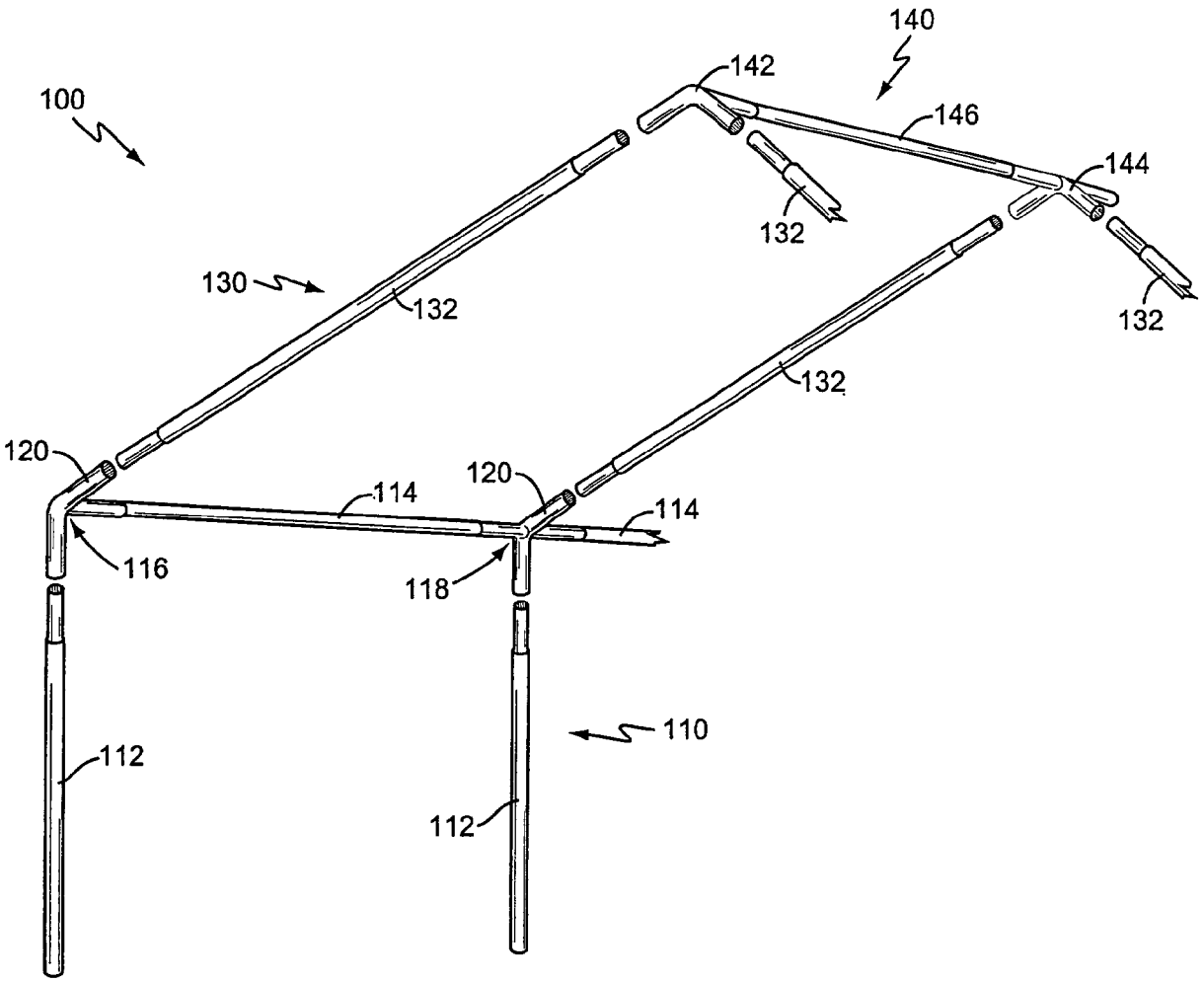
FIG. 3 illustrates a portion of a frame structure corresponding to FIG. 1.
Figure 4:
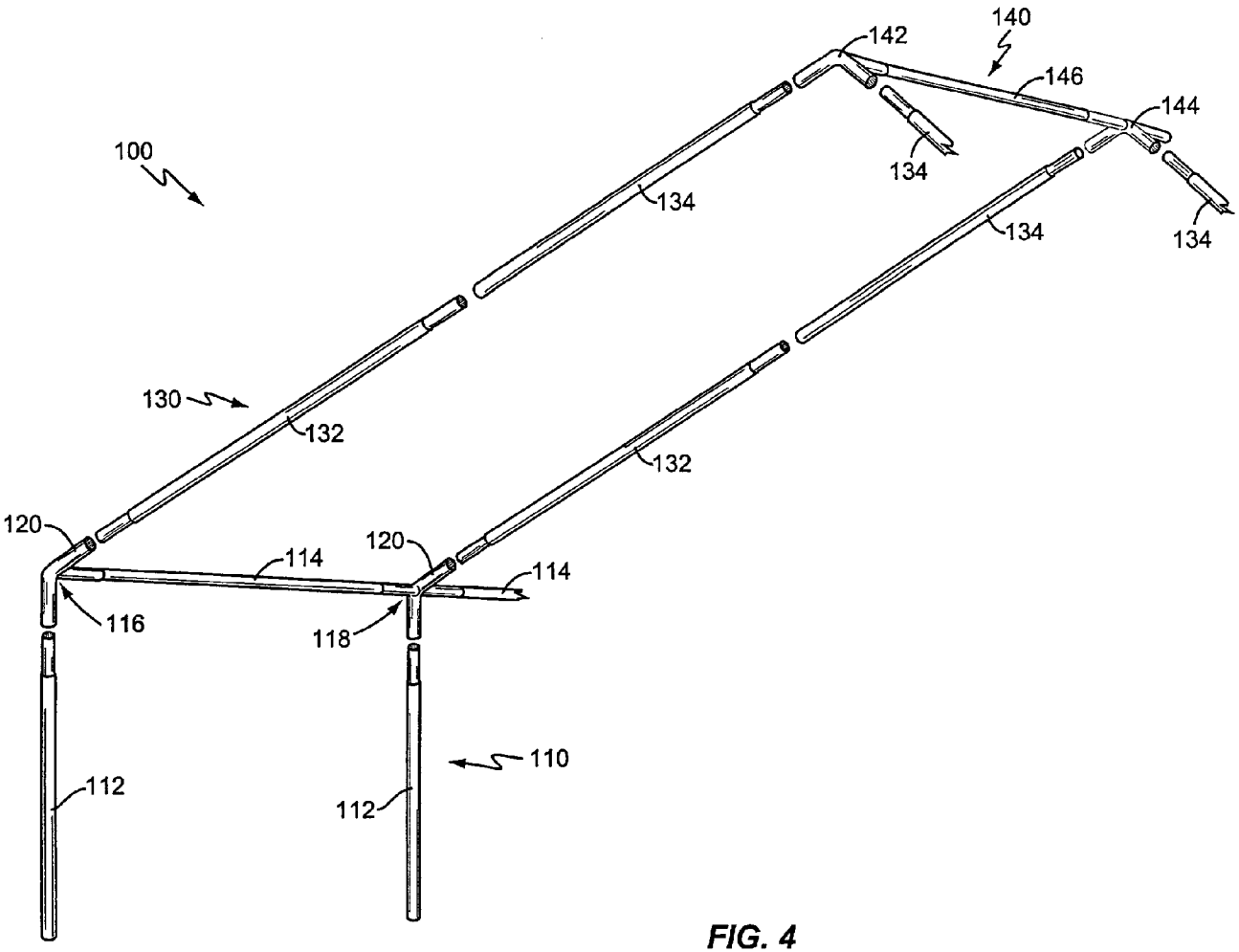
FIG. 4 illustrates a portion of a frame structure corresponding to FIG. 2.

Basically, the canopy kit includes components to form a frame structure 100, as seen in FIGS. 3 and 4, and one or more covers that are adapted to fit multi-size frame structures. The components forming the frame structure 100 are of the pipe or tubular type, with the individual components adapted to be joined together in conventional fashion. The frame structure components include a series of components that are adapted to form a pair of side frames indicated generally by the numeral 110, a ridge member 140, and a series of roof members 130. Each roof member 130 includes a series of sections adapted to be joined end to end. In the particular kit disclosed herein, each roof member component of the kit includes a first section 132 and a second section 134. In the larger canopy version, such as shown in FIG. 2, each roof member 130 includes both first and second sections 132 and 134 joined together. As will be appreciated from subsequent portions of this disclosure, this permits the assembly and erection of a relatively wide canopy structure 10. If a more narrow canopy is desired, one of the first or second sections 132 or 134 can be eliminated. This will produce a canopy structure 10 such as that shown in FIG. 1.

Provided in the canopy kit to form the pair of side frames 110, is a series of support legs 112 and a series of intermediate horizontal sections 114. As seen in the drawings, the intermediate sections 114, when the canopy is assembled and erected, extend generally horizontally between the respective support legs 112. Also, forming a part of the side frames is a series of connecting joints 116 and 118. Connecting joints 116 are referred to as three-way side connection joints while the other joints 118 are referred to as four-way side connecting joints. Essentially, the connecting joints 116 and 118 interconnect the respective legs 112 with the intermediate sections 114 and the roof members 130.

Finally, the frame structure of the canopy includes the ridge member 140 which in turn is made up of series of ridge beams 146 connected together by three-way and four-way connecting joints 142 and 144. As seen in the drawings, the connecting joints 142 and 144 connect the ridge beam components 146 with the roof members 130.

Finally, the kit of the present invention is provided with one or more covers. In the case of one embodiment, the kit is simply provided with two covers 200, 202 of different sizes. In another embodiment, the kit is provided with an expandable cover 204 that is adapted to fit frame structures 100 of various sizes.

The frame structure 100 illustrated in FIG. 3 forms a canopy 10 shown in FIG. 1. The expandable frame structure 100 of canopy 10 comprises two side frames 110, a plurality of roof members 130, and a ridge member 140.

Each side frame 110 comprises support legs 112, intermediate sections 114, three-way side connection joints 116, and four-way side connection joints 118. Support legs 112 include lower portions that are adapted to be extended into a support surface such as the ground or may be embedded in concrete. A distance generally corresponding to the length of an intermediate section 114 separates each support leg 112 of a side frame 110.

The three-way and four-way side connection joints 116 and 118 interconnect the intermediate sections 114 to the support legs 112 such that the intermediate sections 114 are generally perpendicular to the support legs 112 and generally parallel to the underlying ground or support surface. Each side connection joint 116, 118 comprises at least two perpendicular connecting arms. These generally coplanar connecting arms are arranged in an L-shape in the case of a three-way joint and in a T-shape in the case of a four-way joint. In addition, each side connection joint 116, 118 comprises a roof connecting arm 120, generally oriented at an angle less than 90 degrees, relative to the plane of the perpendicular connecting arms. These roof-connecting arms 120 include a port or opening for the roof members 130.

The ridge member 140, which extends generally parallel to the side frames 110, comprises a plurality of ridge beams 146 disposed between three-way ridge connection joints 142 and four-way ridge connection joints 144. The length of the ridge member 140 is generally equivalent to the length of the side frames 110. A frame structure 100 of a first width, shown in FIG. 1, is completed when opposite ends of each first section 132 are inserted between the ridge connection joints 142, 144 and side frame connection joints 116, 118. See FIG. 3.

FIG. 4 illustrates an expanded frame structure 100. Disposing a second section 134 between the first section 132 and the ridge connection joint 142 or 144 of each roof member 130 expands the frame structure to a second width. While this detailed description will focus on expandable canopy kits comprising frame structures 100 that are expandable from one width to a second width, it should be apparent to one skilled in the art that adding more sections to the roof member 130 will further expand the width of the frame structure 100.

Once the frame structure 100 is erected, a cover may be secured to the frame structure 100. In one embodiment, the canopy kit includes two separate covers 200 and 202 manufactured to fit different size different frame structures 100. FIGS. 1 and 2 illustrate this embodiment. In this embodiment, the respective covers 200, 202 are sized to fit two different size frame structures 100. Basically, the frame structures of FIGS. 1 and 2 are of the same length but the width of the canopy structure 10 in FIG. 2 is wider than the width of the canopy structure 10 shown in FIG. 1. Consequently, the two covers 200 and 202 are particularly sized to fit the two different sized frame structures 100. Details of these cover designs are not dealt with herein because such cover designs are well-known and appreciated by those skilled in the art. For a more complete and unified understanding of the structure and design of such covers, reference is made to U.S. Pat. No. 6,155,280, which is expressly incorporated herein.

Figure 5:
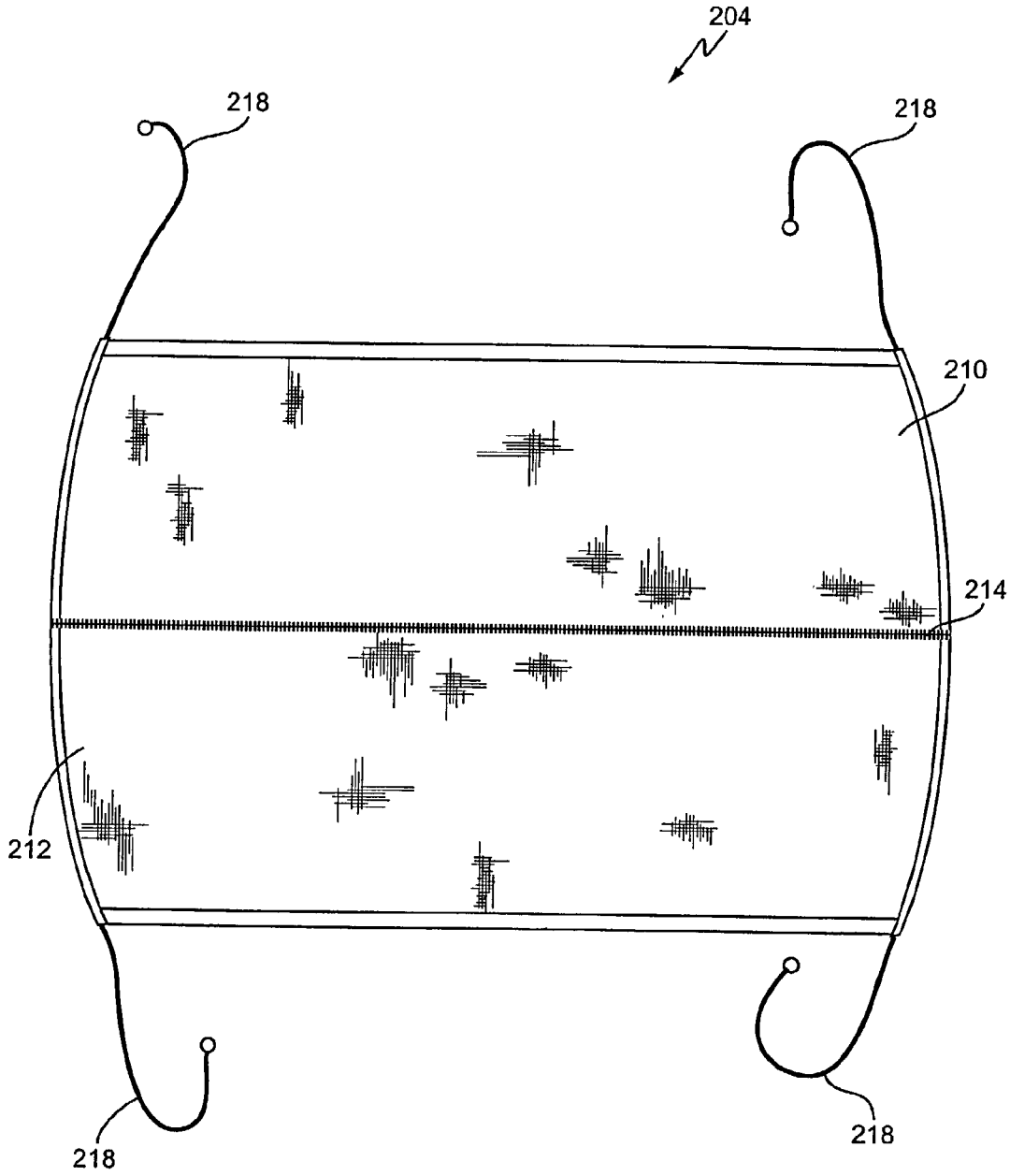
FIG. 5 is a plan view of an expandable cover for the canopy kit of the present invention.
Figure 6:
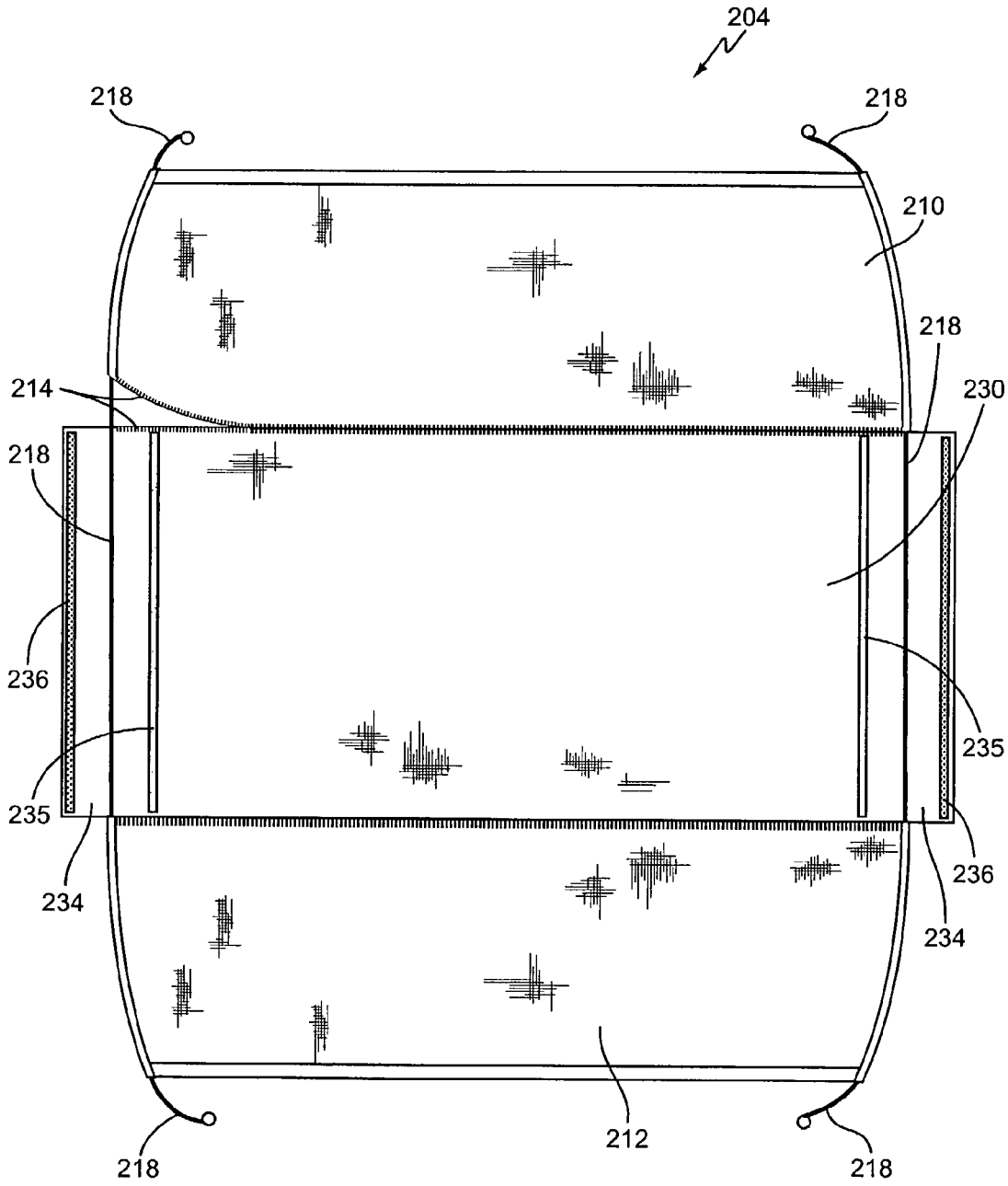
FIG. 6 illustrates the cover of FIG. 5 in an expanded configuration.

The canopy kit of the present invention includes an alternative cover design which utilizes a single cover that is expandable to fit frame structures of various widths. FIG. 5 illustrates an expandable cover 204 of a first width. The expandable cover 204 comprises a first panel 210, a second panel 212, tie cords 218, and an expansion or insert panel 230 (FIG. 6). A panel fastener such as a zipper 214 connects the first panel 210 with the second panel 212. When the two panels 210 and 212 are connected together, as illustrated in FIG. 5, the formed cover 204 is adapted to fit a frame structure 100 of a first width or size.

The cover 204 can be converted to a second width. This is illustrated in FIG. 6. To convert the cover 204 shown in FIG. 5 to a second width, the expansion panel 230 is connected between the first and second panels 210 and 212. The expansion panel 230 includes fasteners for connecting to the panels 210 and 212. In one embodiment the fasteners comprise zipper assemblies. In one case, the zipper 214 utilized for connecting the two panels 210 and 212 together can be utilized to work in conjunction with zipper halves or components that are formed on each edge of the expansion panel 230. Alternatively, the zipper halves or components formed on opposite sides of the expansion panel 230 can be adapted to connect to entirely different zipper halves or components formed on the interior edges of the panels 210 and 212.

As seen in FIGS. 5 and 6, the expandable cover 204 includes opposed tie cords 218 that extend through closed seams formed on opposite ends of the panels 210 and 212. When the insert panel 230 is inserted between panels 210 and 212, it follows that a segment of the tie cord 218 on each end of the cover 204 may be exposed. To enclose the segments of the tie cords 218 that extend between the panels 210 and 212 in the expanded version of the cover 204, as shown in FIG. 6, the insert or expansion panel 230 is provided with a pair of opposed flaps 234. The flaps 234 are adapted to fold back and attach to the insert panel 230 at a point inwardly of the tie cords 218. Thus, when the flaps 234 are so folded and secured, the tie cords 218 extending between the panels 210 and 212 are concealed. To secure the flaps 234 in the folded position, various fasteners may be used. In one embodiment, the fasteners include hook and loop fasteners 235 and 236 as illustrated in FIG. 6.

Therefore, it is appreciated that the canopy kit of the present invention enables at least two different size canopy structures 10 to be assembled and erected from the components therein. In the case of the embodiment illustrated herein, the size of the canopies are adjustable transversely. That is, the kit can be utilized to assemble and erect canopies of various widths. To accomplish this, the present invention provides a frame structure 100 that includes an expandable roof structure. More particularly, the kit of the present invention provides a plurality of roof members 130 that extend from the respective side frames 110 to the ridge member 140. In the embodiment illustrated herein, the roof members 130 are said to be expandable. They are expandable in terms of the embodiment disclosed since each roof member 130 includes two separate sections 132 and 134. The two sections 132 and 134 can be joined together to form an expanded frame structure 100 such as shown in FIGS. 2 and 4. Alternatively, one section of each roof member 130 can be eliminated from the canopy structure 10 and this will form a relatively narrow canopy structure 10 such as shown in FIGS. 1 and 3. It should be understood that there are other structures and designs that can be utilized in lieu of the multi-sectional roof members 130. For example, each roof member 130 could be expandable through a telescoping structure. In addition, it should also be appreciated that the length of the canopy structure 10 can be extended or retracted by adding or removing ridge members 140 and the corresponding roof members 130, support legs 112, and intermediate horizontal sections 114.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A canopy kit structure comprising:

a frame structure comprising a ridge member, at least two side frames, and a plurality of roof members;

wherein the plurality of roof members are disposed on opposing sides of the ridge member between the ridge member and the side frames, and further wherein the plurality of roof members are traversely expandable such that the canopy structure when erected may assume a first width or a second width;

at least one convertible cover adapted to be supported by the frame structure and adaptable to the first width and second width;

each roof member comprises a first section and a second section, and wherein when the canopy structure is erected and assumes the first width, the first section of each roof member is utilized and wherein when the canopy structure is erected and assumes the second width, the first and second sections of the roof member are utilized;

the convertible cover comprises a first panel, a second panel, at least one tie cord contained within opposing ends of the first and second panels, and an expansion panel disposed between the first and second panels and including a flap on at least one opposing end of the expansion panel; and the first panel, the second panel, and the expansion panel comprise separate, interconnecting sections of the convertible cover.

2. The canopy structure of claim 1 wherein the convertible cover comprises a continuous convertible cover comprising the expansion panel disposed between the first and second panels.

3. The canopy structure of claim 2 wherein the convertible canopy adapts to the first width of the canopy structure when the first panel is directly connected to the second panel, and wherein the connected first and second panels conceal the expansion panel.

4. The canopy structure of claim 3 wherein the concealed expansion panel folds and attaches to a first side of at least one of the first panel, the second panel, and the frame structure.

5. The canopy structure of claim 2 wherein the convertible canopy adapts to the second width of the canopy structure by separating the first and second panels, thereby spanning the distance between the separated first and second panels with the expansion panel.

6. The canopy structure of claim 5 wherein the at least one flap of the expansion panel wrap around exposed tie cords extending between the first and second panels, and attach to a first side of at least one of the expansion panel, the first panel, the second panel, and the frame structure.

7. The canopy structure of claim 1 wherein the convertible cover adapts to the second width of the canopy structure when the expansion panel, inserted between the first panel and the second panel, connects the first and second panels.

8. The canopy structure of claim 7 wherein the flaps of the inserted expansion panel wrap around exposed tie cords extending between the first and second panels and attach to a first side of at least one of the inserted expansion panel, the first panel, the second panel, and the frame structure.

9. The canopy structure of claim 7 wherein the convertible canopy adapts to the first width of the canopy structure by removal of the expansion panel and direct connection of the first panel to the second panel.

10. A canopy kit structure comprising:

a frame structure comprising a ridge member, at least two side frames, and a plurality of roof members;

wherein the plurality of roof members are disposed on opposing sides of the ridge member between the ridge member and the side frames, and further wherein the plurality of roof members are traversely expandable such that the canopy structure when erected may assume a first width or a second width;

at least one convertible cover adapted to be supported by the frame structure and adaptable to the first width and second width;

each roof member comprises a first section and a second section, and wherein when the canopy structure is erected and assumes the first width, the first section of each roof member is utilized and wherein when the canopy structure is erected and assumes the second width, the first and second sections of the roof member are utilized;

the convertible cover comprises a first panel, a second panel, at least one tie cord contained within opposing ends of the first and second panels, and an expansion panel disposed between the first and second panels and including a flap on at least one opposing end of the expansion panel;

the convertible cover comprises a continuous expansion panel disposed between the first and second panels; and wherein the convertible canopy adapts to the first width of the canopy structure when the first panel is directly connected to the second panel, and wherein the connected first and second panels conceal the expansion panel.

11. The canopy structure of claim 10 wherein the concealed expansion panel folds and attaches to a first side of at least one of the first panel, the second panel, and the frame structure.

12. The canopy structure of claim 10 wherein the convertible canopy adapts to the second width of the canopy structure by separating the first and second panels, thereby spanning the distance between the separated first and second panels with the expansion panel.

13. The canopy structure of claim 10 wherein the at least one flap of the expansion panel wrap around exposed tie cords extending between the first and second panels, and attach to a first side of at least one of the expansion panel, the first panel, the second panel, and the frame structure.

14. The canopy structure of claim 10 wherein the first panel, the second panel, and the expansion panel comprise separate, interconnecting sections of the convertible cover.

15. The canopy structure of claim 14 wherein the convertible cover adapts to the second width of the canopy structure when the expansion panel, inserted between the first panel and the second panel, connects the first and second panels.

16. The canopy structure of claim 15 wherein the flaps of the inserted expansion panel wrap around exposed tie cords extending between the first and second panels and attach to a first side of at least one of the inserted expansion panel, the first panel, the second panel, and the frame structure.

17. The canopy structure of claim 15 wherein the convertible canopy adapts to the first width of the canopy structure by removal of the expansion panel and direct connection of the first panel to the second panel.

* * * * *